US005348191A

United States Patent [19]

Dekeyser

[11] Patent Number: 5,348,191

[45] Date of Patent: Sep. 20, 1994

[54] DEVICE FOR STORAGE AND DISPENSATION OF MEASURED QUANTITIES OF PASTY MATERIALS AND PROCESS FOR ITS EMBODIMENT

[76] Inventor: Michel Dekeyser, Kestergat 9, B-1670, Pepingen, Belgium

[21] Appl. No.: 863,297

[22] PCT Filed: Dec. 28, 1990

[86] PCT No.: PCT/BE90/00073

§ 371 Date: Jun. 26, 1992

§ 102(e) Date: Jun. 26, 1992

[87] PCT Pub. No.: WO91/11371

PCT Pub. Date: Aug. 8, 1991

[30] Foreign Application Priority Data

Jan. 26, 1990 [BE] Belgium ..... 090 00100

[51] Int. Cl.[5] ..... B65D 47/10

[52] U.S. Cl. ..... 222/107; 222/541

[58] Field of Search ..... 222/92, 107, 541

[56] References Cited

U.S. PATENT DOCUMENTS

| | | | |
|---|---|---|---|
| 2,705,579 | 4/1955 | Mason | 222/107 |
| 2,956,710 | 10/1960 | O'Connor | 222/107 |
| 3,917,116 | 11/1975 | Mason | 222/107 X |
| 4,493,574 | 1/1985 | Redmond et al. | 222/107 X |
| 4,611,715 | 9/1986 | Redmond | 222/107 X |

FOREIGN PATENT DOCUMENTS

| | | |
|---|---|---|
| 0025621 | 3/1981 | European Pat. Off. . |
| 0178918 | 4/1986 | European Pat. Off. . |

*Primary Examiner*—Kevin P. Shaver

*Attorney, Agent, or Firm*—Oblon, Spivak, McClelland, Maier & Neustadt

[57] ABSTRACT

A device for storage and dispensation of measured quantities of pasty material. The device is formed from two juxtaposed formable sheets including, respectively, a compartment forming a volume housing the measured quantity and a passage forming a duct for ejection of the measured quantity, as well as deformable membrane constituting a sealing mechanism which separates the compartment from the passage. The invention is applicable to packaging and dispensation of measured quantities of a pasty material.

7 Claims, 1 Drawing Sheet

DEVICE FOR STORAGE AND DISPENSATION OF MEASURED QUANTITIES OF PASTY MATERIALS AND PROCESS FOR ITS EMBODIMENT

TECHNICAL FIELD

The present invention concerns a device for storage and dispensation of measured quantities of a pasty material, as well as the process for manufacture of a device of this kind.

BACKGROUND ART

In the sphere of packaging of measured quantities of materials, in particular unitary measured quantities, conventional practice calls for packaging the liquid or pasty substances in small cushions which can be cut or torn in order to allow access to the liquid or pasty material. Patent No. EP-A-0 178 918 describes a form of tearable packaging for liquid or pasty substance which results from the development of this type of packaging. As regards packaging of individual solid objects, in particular drug packaging, the packaging is conventionally produced using a sheet of formable material comprising compartments in which the objects to be packaged are placed, and the compartments are sealed by attaching the surface of the formable sheet which extends away form the compartments to a sheet of material, which, since it has a lesser resistance than the formable sheet, can be torn by crushing said compartment and exerting pressure on the object contained therein.

DISCLOSURE OF THE INVENTION

The purpose of the present invention is to provide packaging for measured quantities of a pasty material, this packaging being similar, as regards its application, to the conventional packagings described above for individual solid objects.

This goal is achieved by supplying a device for storage and dispensation of measured quantities of a pasty substance, which comprises a volume housing the measured quantity of said substance and means for sealing this volume, which can be opened to allow the ejection of the measured quantity of the material, this device comprising two formable, juxtaposed sheets, one of which incorporates a first deformation extending away from the surface at which the two sheets are joined, existing as a compartment creating the volume which houses the measured quantity of pasty material, device in which the other sheet incorporates a second deformation existing as a channel which forms a duct for the ejection of the measured quantity of pasty substance, this ejection duct, which is open at one of its ends, opening opposite the compartment at its other end, and in which a deformable membrane constituting a seal separates the compartment from the duct, the two sheets ensuring position-retention of the membrane being attached in at least the peripheral area of the compartment.

By virtue of an additional invention feature, the surface at which the two sheets of formable material are joined lies in one plane, and the deformable membrane is a flat membrane lying in this same plane.

By virtue of another special feature of the invention, the deformable membrane is an extensible film which, when subjected to the pressure exerted on the pasty material when the compartment is crushed, can be deformed in order to allow the pasty substance to be engaged in the ejection duct.

According to another special feature of the invention, the flat deformable membrane is a pre-cut film whose weakened area lies in the area of the duct and is designed to be torn when subjected to the pressure exerted on the pasty material when the compartment is crushed, in order to allow the pasty material to enter the ejection duct.

According to a further feature, the two formable sheets and the membrane are attached in at least the peripheral areas of the compartment and of the duct, which correspond, in the two formable sheets, to non-deformed areas.

By virtue of still another invention feature, the deformable membrane, whose edges, taken in the longitudinal direction of the duct, lie in immediate proximity to the peripheral area of the compartment, does not contribute to formation of the seal between the sheets of formable material, and is, in consequence, designed to slide between these sheets when subjected to the pressure exerted on the pasty material when the compartment is crushed, thereby taking on the shape of the duct, said membrane being attached, by the end opposite the duct, to at least the sheet in which the channel is created, so as to prevent it from being carried away by the pasty material.

By virtue of another invention feature, the membrane is additionally attached, in the area of the duct and using a light adhesive, to the sheet in which the compartment is formed, so as to form, at this spot, a connection which can easily be broken.

The invention is further intended to provide a process for production of a device for storage and dispensation of measured quantities of a pasty material, characterized by the fact that this process consists in forming compartments in a first sheet of formable material and, in a corresponding manner, ducts in a second sheet of formable material; in filling the compartments with measured quantities of a pasty material; in placing a deformable membrane at least partially over the compartments; in juxtaposing, by their surfaces extending away from the deformations, the first and second sheets of formable material, in such a way that the ducts are positioned, in conjuction with the compartments, so as to create passages leading to said compartments at the place of the deformable membrane; and in attaching the two sheets of formable material in at least the peripheral area of each compartment.

According to another invention feature, this process comprises the following steps:

heat-forming compartments and passages, respectively, in the longitudinal direction of the two halves of a sheet made of a continuously-fed thermoformable material;

filling, in a continuous operation, the compartments with measured quantities of a pasty material;

covering, in a continuous operation, the compartments with a film of deformable material;

folding, in a continuous operation, the half of the sheet incorporating the passages over the half of the sheet comprising the compartments so as to form ducts which are sealed by the film of deformable material at the points where they open into the compartments;

fusing, in a continuous operation, the two superposed halves of the thermoformable sheet to each other and with the sheet of deformable material, in at least the peripheral areas of the compartments and ducts; and cutting out, in a continuous operation, the product obtained, so as to form sets of measured quantities and, where necessary, freeing the ends of the ducts remote from the compartments.

BRIEF DESCRIPTION OF DRAWINGS

The invention will be better understood by referring to the description provided below and to the attached drawings which illustrate, solely as examples, various embodiments of the invention and in which.

MODES FOR CARRYING OUT THE INVENTION

Figure 1:
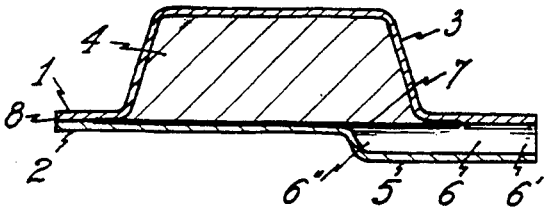
FIG. 1 is a raised cross-section of a device according to the invention.

In accordance with the embodiment illustrated in FIG. 1, the device according to the invention is created from two formable sheets 1, 2 and a membrane 7. The formable sheet 1 comprises a compartment-shaped deformation 3 designed to house a measured quantity of a pasty material 4, while the formable sheet 2 comprises a duct-shaped deformation 5. Sheets 1 and 2 are juxtaposed in such a way that their respective deformations 3 and 5 extend away from the surface 8 at which the two sheets are joined, and so that the passage 5, which forms, in conjuction with the sheet 1, an ejection duct 6 open at one of its ends 6', ends, at its other extremity 6'' opposite the compartment 3. The membrane 7, positioned along the surface 8 joining sheets 1 and 2, separates the compartment 3 containing the measured quantity of pasty material 4 and the duct 6 opening to the outside. The membrane 7 is held in place along the junction surface 8 by sheets 1 and 2, which are, for example, bonded or fused together, the membrane 7 forming a component of this assembly, which must be created in at least the peripheral area of the compartment.

Figure 2:
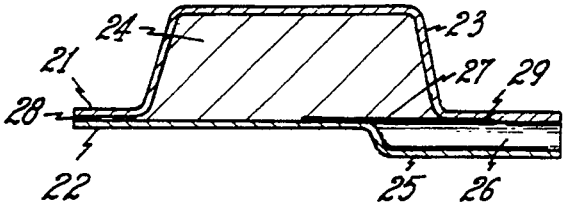
FIG. 2 is a raised cross-section of another embodiment of the device according to the invention.
Figure 3:
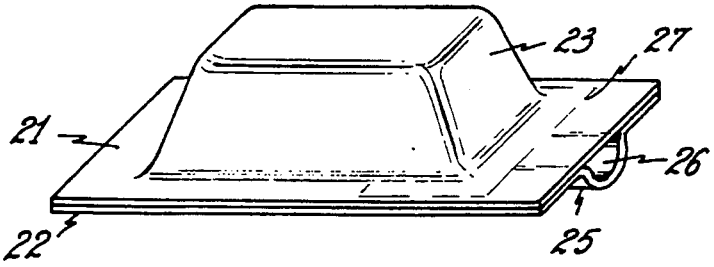
FIG. 3 is a perspective view of the device illustrated in FIG. 2.

The embodiment illustrated in FIGS. 2 and 3 corresponds appreciably to the embodiment in FIG. 1, the sheets 21, 22, the compartment 23, the measured quantity of material 24, the passage 25, and the duct 26 corresponding substantially and respectively to the sheets 1, 2, the compartment 3, the measured quantity of material 4, the passage 5, and the duct 6 in FIG. 1. The difference lies in the membrane 27, which, in contradistinction to the membrane 7, extends over only one part of the compartment 23. As can be seen more clearly in FIG. 3, the membrane 27 is limited not only longitudinally (i.e., in the longitudinal direction of the duct 26) in relation to the compartment 23, but also transversely. Accordingly, either the membrane 27 forms a component in the assembly of sheets 21 and 22, or it remains unattached between the assembled sheets 21 and 22, an arrangement in which these sheets ensure only that the membrane 27 is held in place. According to the embodiment illustrated in FIG. 2, the membrane 27 is bonded to sheet 21 at point 29, i.e., in the area of the duct 26. This bonding is achieved using a light adhesive which can easily be broken. This bonding arrangement 29 is recommended mainly when the membrane 27 does not form part of the attachment between the sheets 21 and 22.

The deformable membrane 7 or 27 is either an extensible or a tearable membrane, if it contributes to the creation of a joint between sheets 1 and 2 or 21 and 22, respectively, i.e., if it is bonded or fused with said sheets; or, yet again, a membrane which is merely deformable, when it does not contribute to formation of the joint between the sheets 21 and 22, i.e., when the connection formed by bonding/fusing of said sheets in the peripheral area of the compartment bypasses said membrane.

During storage, the membrane 7, 27, which is secured in place against the measured quantity 4, 24 of pasty material when the packaging is formed, is held in that position, first, by means of the retention action exerted by the sheets 1, 2; 21, 22, and second, in the area of the duct by means of atmospheric pressure, potentially reinforced by the action of the bonding arrangement 29.

During use, crushing the compartment 3, 23 generates, by means of the measured quantity of pasty material 4, 24, pressure on the membrane 7, 27. When the membrane forms a component of the assembly of the sheets 1, 2, 21, 22, the membrane 7, 27 is deformed either by stretching, until it adopts substantially the shape of the duct, or by tearing, if the membrane is, for example, a pre-cut film whose weakened area lies in the area of the duct 6, 26. When the membrane 27 does not form part of the assembly of the sheets 21, 22, i.e., when, as described above, the bonding or fusing area does not incorporate the membrane 27, the deformation will entail, after rupture of the bonding attachment 29, slippage of the sheet until it takes on the shape of the duct 26. In this last case, the membrane is also attached, for example by adhesive bonding, by its end opposite to the duct 26, in order to avoid being carried outside the compartment 23 by the pasty material 24.

Solely as an example and in accordance with an embodiment of the invention, the formable sheets 1, 2, 21, 22 are made of a 150-micron thermoformed film, while the deformable membrane is a extensible 10-micron polyethylene film capable of being stretched up to 600%.

Figure 4:
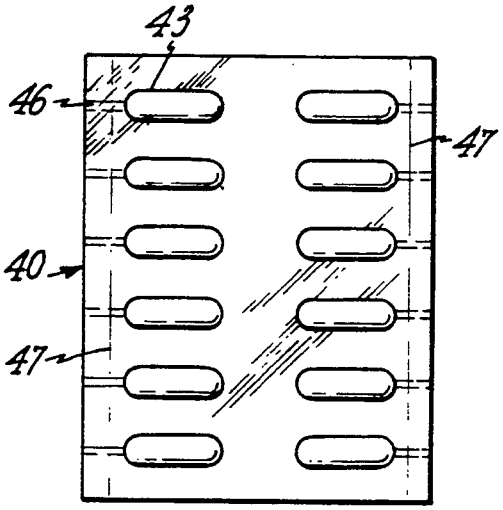
FIGS. 4 and 5 are plane views of two embodiments of packages which implement the device according to the invention.

In FIG. 4, rectangular-shaped packaging 40 comprises two rows of compartments 43, each compartment 43 being connected to the outside of the packaging by means of a duct 46, while a membrane 47 covers the two rows of compartments 43 in such a way that it is interposed between said compartments and the ends of the ducts 46 which open into them. As regards a single compartment, this embodiment is, therefore, similar to that illustrated in FIG. 1.

Figure 5:
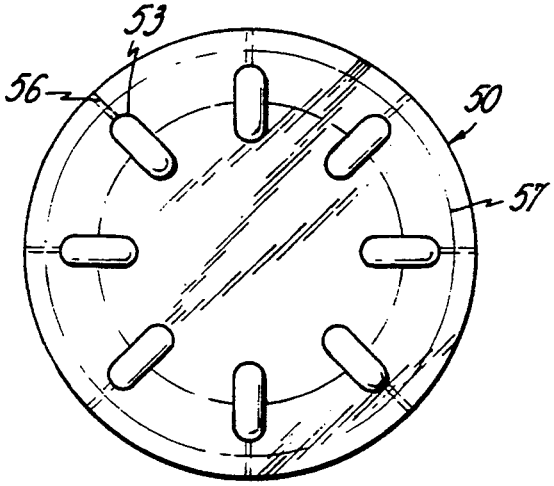

According to the embodiment in FIG. 5, circular packaging 50 comprises a series of compartments 53 arranged radially, each compartment being connected by a duct 56, also radial, to the outside of the packaging, and an annular membrane 57 is interposed between the ends of the compartments 53 extending toward the ducts 56 and the ducts themselves. This embodiment corresponds substantially to the embodiment illustrated in cross-section in FIG. 2.

The invention further concerns the process for manufacture of a device such as that illustrated in FIGS. 1 to 5. This process consists, in general, of the following steps: forming compartments 3, 23 in a sheet of formable material 1, 21 and, correspondingly, producing ducts 5, 25 in a second sheet of formable material 2, 22; filling the compartments 3, 23 with measured quantities 4, 24 of a pasty material; arranging a deformable membrane 7, 27 at least partially on the compartments 3, 23; juxtaposing, by means of their surface extending away from the deformation, the first and second sheets of deformable material in such a way that the passages 5, 25 are positioned in relation to the compartments 3, 23 so as to form ducts 6, 26 which open, at one end, into the compartments at the place of the deformable membrane 7, 27, and, at the other, into the open air, the membrane 7, 27 being held in place between the sheets of formable material 1, 2, 21, 22; and in attaching the sheets of formable material, in at least the peripheral area of each compartment.

Figure 6:
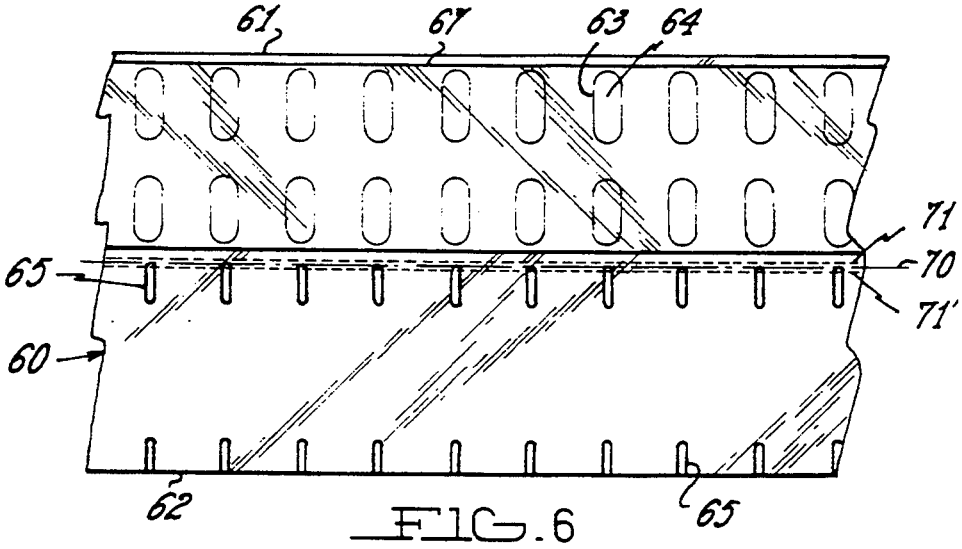
FIG. 6 is a plane view of one step in the process for manufacture of a device according to the invention.

According to a preferred embodiment, of which one step is illustrated in FIG. 6, the process according to the invention entails heat-forming compartments 63 and passages 65 in the two halves 61, 62, taken longitudinally, of a sheet 60 made of a continuously-fed thermoformable material; filling, in a continuous operation, the compartments 63 with measured quantities 64 of a pasty material; covering, in a contiuous operation, the compartments with a film 67 of a deformable material (step illustrated in FIG. 6); folding over, in a continuous operation, the half 62 of the sheet 60 containing the passages 65 over the half of the sheet 60 containing the compartments 63 in order to form ducts, which are sealed by the film of deformable material 67 at the point where they terminate in the compartments 63; fusing, in a continuous operation, the superposed two halves 61, 62 of the thermoformable sheet 60, both together and with the film 67 of deformable material in all of the areas located to the outside of the compartments 63 and passages 65; trimming, in a continuous operation, the edge of the product obtained corresponding to the fold line 70, in the area between the dotted lines 71; 71', so as to clear the ends of the passages 65 remote from the compartments 63; and finally, cutting the continuously-formed product in order to produce packages such as that 40 illustrated in FIG. 4.

In the various embodiments illustrated in the drawings, the connection surface 8, 28 between the formable sheets 1,2 and 21, 22, respectively, has been illustrated as being flat; it is obvious that this arrangement will constitute the invention embodiment most frequently used. However, it will be understood that this connection surface may exist as a left-handed surface, in which case the formable sheets 1, 2, 21, 22 will have matching shapes, or that the specific shape of the assembly will be imparted during a shaping operation performed in conjunction with the fusing operation joining the sheets to each other and to the deformable membrane.

I claim:

1. Device for storage and dispensation of measured quantities of a pasty material, including a housing for the measured quantity of the material and a mechanism for sealing the housing, which is openable for each action of the measured quantity of material, wherein the device comprises:

first and second juxtaposed formable sheets having first and second deformations, respectively, extending away from a connection surface joining the first and second sheets wherein the first deformation comprises a compartment forming a volume which houses the measured quantity of the pasty material, and the second deformation in the second sheet comprises a duct for the ejection of the measured quantity of pasty material, wherein the ejection duct is continuously opened at one end thereof and terminates at another end thereof at a position next to the compartment; and said sealing mechanism includes a deformable membrane which separates the compartment from the duct wherein the first and second formable sheets are assembled in at least the peripheral area of the compartment for holding the membrane in place.

2. Device for storage and dispensation of measured quantities of a pasty material according to claim 1, wherein the connection surface of the two sheets lies in one plane, and wherein the deformable membrane is a flat membrane lying in said plane.

3. Device for storage and dispensation of measured quantities of a pasty material according to claim 2, wherein the deformable membrane comprises an extensible film which is, when subjected to the pressure exerted on the pasty material by crushing the compartment, deformable so as to allow the pasty material to flow into the ejection duct.

4. Device for storage and dispensation of measured quantities of a pasty material according to claim 2, wherein the flat deformable comprises a pre-cut film having a weakened area located in the area of the duct which is torn when subjected to the pressure exerted on the pasty material by crushing the compartment, in order to allow the pasty material to flow into the ejection duct.

5. Device for storage and dispensation of measured quantities of a pasty material according to claim 3, wherein the deformable membrane has edges, taken in the longitudinal direction of the duct, which are located in immediate proximity to a peripheral area of the compartment, do not form part of the connection between the sheets of formable material and are slidable between said sheets when subjected to pressure exerted on the pasty material when the compartment is crushed, thereby assuming the shape of the duct, said membrane being attached, at an end thereof opposite the duct, to at least the sheet in which the passage is formed, so as to avoid being carried away by the pasty material.

6. Device for storage and dispensation of measured quantities of a pasty material according to claim 1, wherein the first and second formable sheets and the membrane are assembled together in at least the peripheral areas of the compartment and the duct and wherein the peripheral areas comprise non-deformed areas.

7. Device for storage and dispensation of measured quantities of a pasty material according to claims 3 or 4, wherein the membrane is attached in the area of the duct to the sheet in which the compartment is formed by an adhesive so as to form a point of attachment which is breakable.

* * * * *